United States Patent [19]

Halstrum

[11] 4,221,946

[45] Sep. 9, 1980

[54] REMOTE SWITCH CONTROL

[76] Inventor: James L. Halstrum, #60 10,772 Guildford Dr. Surrey, British Columbia, Canada V3R

[21] Appl. No.: 961,420

[22] Filed: Nov. 16, 1978

[30] Foreign Application Priority Data

Aug. 29, 1978 [CA] Canada ..... 310254

[51] Int. Cl.[2] ..... H01H 3/52

[52] U.S. Cl. ..... 200/331

[58] Field of Search ..... 200/331; 74/10 A, 15.7, 74/89.22, 544

[56] References Cited

U.S. PATENT DOCUMENTS

| | | | |
|---|---|---|---|
| 332,794 | 12/1885 | Dickson | 74/89.22 |
| 511,527 | 12/1893 | Hughes et al. | 200/331 X |
| 729,335 | 5/1903 | Harvey | 200/331 |
| 929,385 | 7/1909 | Burke | 200/331 |
| 2,461,614 | 2/1949 | Seaman | 200/331 |
| 2,466,820 | 4/1949 | Oberschmidt | 200/331 |
| 2,760,035 | 8/1956 | Friesen | 200/331 |
| 3,839,615 | 10/1974 | Bradford | 200/331 |

*Primary Examiner*—Stephen Marcus

*Attorney, Agent, or Firm*—Fleit & Jacobson

[57] ABSTRACT

A switching arrangement comprises a support plate, a slider mounted on the support plate, with guide means on the support plate to constrain movement of the slider, operating means are operable upon the slider to cause movement thereof relative to the support plate. The slider is arranged to engage a switch operating device and cause actuation thereof.

4 Claims, 6 Drawing Figures

REMOTE SWITCH CONTROL

This invention relates to switching arrangements and in particular to switching arrangements suitable for use in domestic installations.

It is of course well known to provide a switch to control lighting arrangements in houses, apartments or the like. Conventional switches are mounted at a height that is convenient for operation by the occupants. This means that the switches are usually placed several feet above the floor which puts them out of reach of children. Thus children cannot regulate the light in the house and particularly in their own bedrooms.

It is not convenient to place the switches at a lower lever since this would inconvenience the remainder of the household. Further there is a certain safety hazard in allowing children direct access to electrical switches.

Thus it is clearly desirable to provide a switching arrangement in which the lights may be controlled by either an adult or a child without exposing the child to unnecessary hazards.

According to the present invention there is provided a switching arrangement comprising a support plate, a slider mounted on the support plate, guide means on the support plate to constrain movement of the slider, and operating means operable upon the slider to cause movement thereof relative to the support plate, the slider being arranged to engage a switch operating device and cause actuation thereof.

An embodiment of the invention will now be described by way of example only with reference to the accompnaying drawings, in which.

Figure 1:
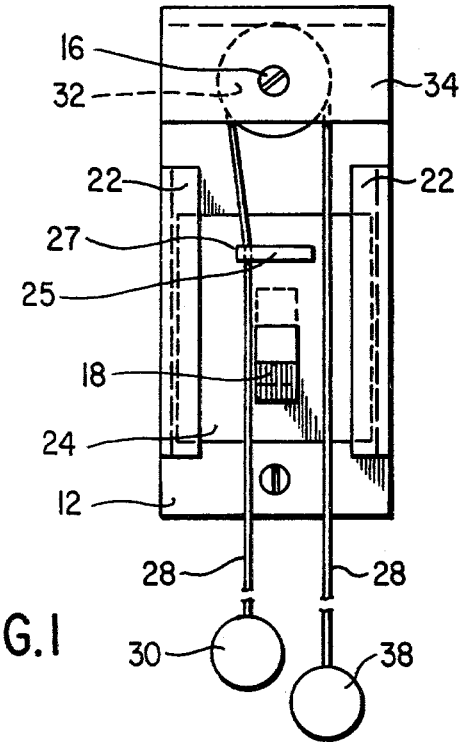
FIG. 1 is an elevation of a switching arrangement.
Figure 2:
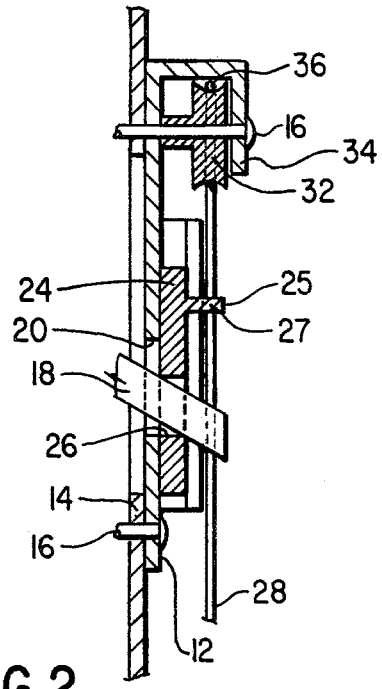
FIG. 2 is a section on the line 2—2 of FIG. 1.

Referring now to FIGS. 1 and 2 a switching arrangement 10 includes a backing plate 12 which is secured to a conventional light switch 14 by means of a pair of screws 16. Screws 16 may conveniently utilize the holes which normally are used to secure the switch 14 in situ on a wall.

The switch 14 includes a toggle member 18 which is connected to the contacts of the switch to control the passage of electric current. The toggle 18 extends through an aperture 20 in the plate 12 and extends beyond the outermost surface of the plate. The aperture 20 is dimensioned to permit the toggle 18 to move between its two extreme positions.

A pair of guide members 22 are integrally formed with the edge of the plate 12 and a slide member 24 is slidingly received within the guides 22. The slide 24 has an aperture 26 which encompasses the extremity of the toggle 18. An upstanding projection is formed on the surface of the slide 24 and has a hole 27 formed therein.

A cord 28 passes through the hole 27 and is secured against movement relative to the hole by means of a knot or other suitable fastening device. The cord 28 depends from the projection 25 and terminates in a wooden knob 30 or the like.

The cord 28 also extends upwardly from the projection 25 and is entrained around a pulley 32 which is supported by an extension 34 of the plate 12. The pulley 32 is rotatably supported upon the shank of one of the screws 16. The pulley 32 is provided with a groove 36 to accommodate the cord and the extension 34 is arranged to be adjacent the periphery of the pulley 32 to assist in retaining the cord 28 in the groove 36. The cord 28 depends from the pulley 32 and terminates in a wooden knob 38 similar to that shown at 30.

The operation of the device is as follows. The lighting circuit controlled by the switch 14 is operated between an "on" and "off" position by movement of the toggle between two extreme position. In order to move the toggle 18 from the position shown in FIG. 1 and 2 the knob 38 is pulled downwardly which causes movement of the cord and corresponding rotation of the pulley 32. The slider 24 is moved upwardly and the walls of the aperture 26 engage the toggle 18 to ensure that it follows movement of the slider. Thus the toggle is moved to its other extreme position and the lights are switched "on" or "off".

Movement of the switch in the other direction is accomplished by pulling on the knob **30*a* which causes downward movement of the slider 24 and corresponding movement of the toggle 18. The length of the cord 28 could be adjusted so that the knobs 30 and 38 are at a convenient height for operation by a child. It will be noted that the toggle 18 projects beyond the slider 24 and thus permits manual manipulation in a normal manner. Direct manipulation of the toggle 18** will cause the slider to move with the toggle so that the switch will always by in a condition for use by a child.

Figure 3:
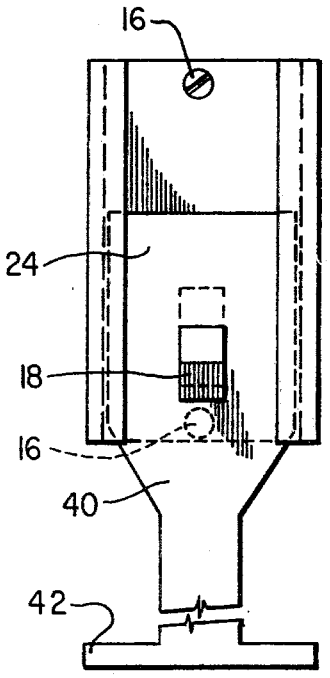
FIG. 3 is a further embodiment of a switching arrangement.

The embodiment shown in FIG. 3 is similar to that shown in FIG. 1 and 2 except that a elongate member 40 is integrally formed with the slider 24. The member 40 can transmit forces in both directions and thus the pulley arrangement used in the embodiments shown in FIGS. 1 and 2 is not required. The member 40 may terminate in a conveniently sized handle 44 to allow operation at a convenient height by a child. Again the toggle extends beyond the slider to permit normal operation of the switch.

Figure 4:
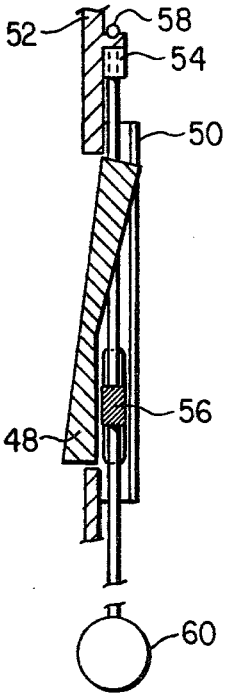
FIG. 4 is a yet further embodiment of a switching arrangement.

The embodiment shown in FIG. 4 is arranged for use with a rocking type of switch. An operating member 48 is pivotally mounted intermediate its ends so that a force applied at either end of the switch will cause it to rotate in an appropriate direction and open or close the contacts of the switch. A pair of guides 50 are integrally formed on the fascia 52 of the switch together with an arcuate surface 54. A bar-like slide 56 is arranged to slide within the guides 50 and extends across the surface of the rocker 48. The slide 56 is formed with legs at either end to ensure that the slide 56 remains perpendicular to the guide 50. A cord 58 is attached to the bar and extends in either direction therefrom. The cord 58 passes over the arcuate surface 54 and the ends of the cord terminate in handles 60.

The rocker 48 is manipulated by pulling on either of the knobs 60 which causes the bar slider 56 to move in an appropriate direction and pivot the rocker about its pivot point. This will cause the switch to open or close. Manual manipulation of the switch may also be accomplished by sliding the bar in the appropriate direction. This action is similar to the action normally associated with such switches and so does not inhibit the operation thereof.

The slide member 56 is dimensioned so that it will permit the rocker 48 to move slightly as the bar passes over the pivot point of the rocker. This movement is sufficient to prevent jamming of the mechanism but does not permit the switch to be moved when the bar is at either extreme position of its travel.

Figure 5:
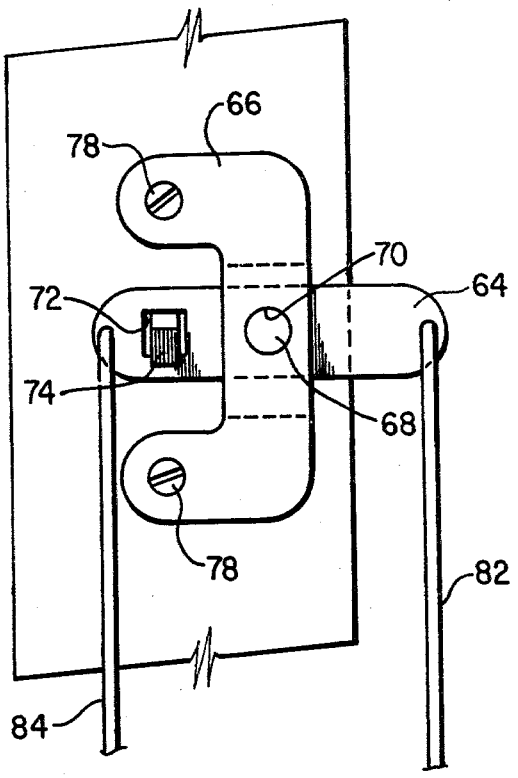
FIG. 5 is a front elevation of a further embodiment of a switching arrangement.
Figure 6:
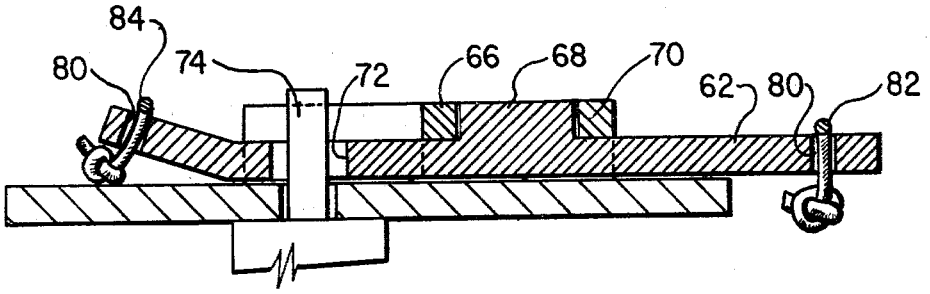
FIG. 6 is a view on the line 6—6 of FIG. 5.

FIGS. 5 and 6 shown an arrangement in which a slider 64 is constrained for pivotal movement relative to a support plate 66. A circular protrusion 68 on the slider 64 is housed in an aperture 70 on the support plate 66 to guide the slider 64.

A square hole 72 is provided in the slider spaced from the protrusion 68. The hole 72 encompasses a switch handle 74 of a switch mechanism.

The support plate 66 is attached to a switch fascia 76 by a pair of screws 78 which may conveniently be used to secure the switch mechanism to the fascia. The support plate 66 is undercut adjacent the aperture 70 so that the support plate may abut the fascia and yet permit pivotal movement of the slider.

The slider 64 is provided with a pair of holes 80 at opposite ends. A pair of cords 82, 84 pass through respective holes and terminate in handles of any convenient form. The cords are secured to the slider by knots.

The switch is operated by pulling on one of the cords, 82, which causes pivotal movement of the slider. The edge of the hole 72 engages the switch handle 74 and moves it to its extreme position. The hole 72 is dimensioned to accommodate the slight lateral movement of the hole 72 during pivotal movement of the slider 64. The switch mechanism may be returned to its other position by pulling of the cord 84.

The arrangement also permits direct operation of the switch handle 74 since it protrudes above the surface of the slider 64.

It will be seen that the above arrangements provide a simple, yet effective switching arrangement which allows manipulation by adults or children without inconveniencing either. Clearly the embodiment shown in FIGS. 1, 2 and 5 could be integrally formed with the fascia of the switch 14 in a manner shown in FIG. 4 or likewise the arrangement of FIG. 4 could be provided as an adapter similar to that shown in FIGS. 1, 2 and 5. The arcuate member 54 of FIG. 4 could be substituted for the pulley arrangement shown in FIGS. 1 and 2 if preferred.

Similarly the arrangement shown in FIG. 5 could be utilized to operate a rocker switch in the manner shown in FIG. 4.

I claim:

1. For use with a lighting switch having a actuating member projecting from a fascia plate, a switch adapter comprising a support plate having an inner peripheral edge extending partially around said actuating member, an outer peripheral edge delimiting said support plate, an undersurface extending between said inner and outer peripheral edges and arranged to abut said fascia plate and a recess in said undersurface extending between said inner and outer peripheral edges, fastening means to attach said support plate to said fascia plate and hole said undersurface in abutment with said fascia plate, an operating lever extending through said recess, said operating lever having an aperture adjacent one end thereof to receive said actuating member, pivot connecting means interconnecting adjacent overlying portions of said recess and said lever, said pivot connecting means including a bore in one of said overlying portions and a projection on the other of said overlying portions extending into said bore and operating means connected to said operating lever to effect pivotal movement thereof, whereby abutment of said undersurface with said fascia plate secures said operating lever within said recess and entraps said projection in said bore to pivotally interconnect said lever and support plate and thereby permit limited pivotal movement therebetween to operate said actuating member.

2. A switch adapter according to claim 1 wherein said projection is integrally formed with said lever.

3. A switch adapter according to claim 1 wherein said operating means includes a pair of flexible cords, a cord being attached at each end of said lever.

4. A switch adapter according to claim 3 wherein one end of said lever adjacent said aperture is cranked to permit attachment of said cord.

* * * * *